US007131240B2

(12) United States Patent
Simmons

(10) Patent No.: US 7,131,240 B2
(45) Date of Patent: Nov. 7, 2006

(54) BUCKET COLUMN BASE AND INSTALLATION SUPPORT

(76) Inventor: Robert J. Simmons, 27308 Fairview Ave., Hayward, CA (US) 94542

( * ) Notice: Subject to any disclaimer, the term of this patent is extended or adjusted under 35 U.S.C. 154(b) by 131 days.

(21) Appl. No.: 10/700,135

(22) Filed: Nov. 3, 2003

(65) Prior Publication Data

US 2004/0093818 A1 May 20, 2004

Related U.S. Application Data

(60) Provisional application No. 60/425,442, filed on Nov. 12, 2002, provisional application No. 60/460,625, filed on Apr. 3, 2003.

(51) Int. Cl.
*E02D 27/32* (2006.01)
*E02D 5/74* (2006.01)

(52) U.S. Cl. ..... 52/297; 52/296; 52/169.9; 52/156; 52/165; 52/298; 52/299

(58) Field of Classification Search ..... 52/169.9, 52/155–165, 298, 299, 296–297, 152, 148
See application file for complete search history.

(56) References Cited

U.S. PATENT DOCUMENTS

| | | | | | |
|---|---|---|---|---|---|
| 1,033,916 | A * | 7/1912 | McProud | 52/296 |
| 1,290,563 | A * | 1/1919 | James | 52/296 |
| 1,463,715 | A * | 7/1923 | Muhlow | 52/297 |
| 1,544,863 | A * | 7/1925 | Ross | 52/295 |
| 1,564,109 | A * | 12/1925 | Ponsolle | 52/297 |
| 1,568,777 | A * | 1/1926 | Smith | 52/146 |
| 1,705,742 | A * | 3/1929 | Werner | 52/149 |
| 3,225,501 | A * | 12/1965 | McCaron | 52/298 |
| 5,271,203 | A * | 12/1993 | Nagle | 52/721.4 |
| 5,485,700 | A * | 1/1996 | Van Vranken | 52/40 |
| 5,913,778 | A * | 6/1999 | Hying et al. | 52/40 |
| 5,946,867 | A * | 9/1999 | Snider et al. | 52/167.1 |
| 5,966,882 | A * | 10/1999 | Naito | 52/295 |
| 6,041,559 | A * | 3/2000 | Schickert et al. | 52/165 |
| 6,061,990 | A * | 5/2000 | McMahon | 52/677 |
| 6,219,981 | B1 * | 4/2001 | Bergelt | 52/294 |
| 6,438,904 | B1 * | 8/2002 | Anzai et al. | 52/167.1 |
| 6,663,322 | B1 * | 12/2003 | Listle | 405/239 |
| 6,702,247 | B1 * | 3/2004 | Takagi | 249/189 |
| 6,729,089 | B1 * | 5/2004 | Spragg | 52/296 |
| 6,799,401 | B1 * | 10/2004 | Legler | 52/169.13 |

* cited by examiner

*Primary Examiner*—Jeanette E. Chapman
(74) *Attorney, Agent, or Firm*—Jon M. Dickinson PC; Robert D. Varitz PC

(57) ABSTRACT

A building foundation anchoring and interface system for receiving supporting the base of an upright structural column. This system and interface includes an open-topped bucket-well structure which is embedded in a foundation, and which is sized so as to permit the received base of an inserted column to be adjusted laterally, in a multidirectional sense, vertically angularly, and axially rotationally, and with substantial clearance, so as to enable easy correct positioning of a column. Poured into the bucket-well structure after the same has received the base of a column is an appropriate fluid-flowable, hardenable, bulk anchoring material, such as conventional building grout material. An opening may be provided in the wall of the base of a column so that such flowable material flows into the interior of a column, as well as into the space between the outside of the column's base and the inside of the receiving bucket-well. The column which has its base received in the bucket-well optionally carries a shoulder-extending foot plate which cooperates with the bulk-anchoring material, and the configuration of the bucket well, to inhibit vertical lifting of a column out of the bucket-well.

3 Claims, 2 Drawing Sheets

BUCKET COLUMN BASE AND INSTALLATION SUPPORT

CROSS REFERENCE TO RELATED APPLICATIONS

This application claims priority to two currently pending, prior filed, U.S. Provisional Patent Applications, one of which bears Ser. No. 60/425,442 covering an invention entitled "Pinwheel Bucket-Well Column-Base Anchor Structure", filed Nov. 12, 2002, and the other of which is U.S. Provisional Patent Application Ser. No. 60/460,625, filed Apr. 3, 2003, covering an invention entitled "Tripod Base with Collar Stabilizer for Upright Column". The inventorship in both of these provisional cases is the same as that in this application, and the entireties of these two provisional patent applications are hereby incorporated herein by reference.

BACKGROUND AND SUMMARY OF THE INVENTION

The present invention relates to installation relative to a foundation, or to what is know in the art as a podium slab, of an upright column which is to form part of a multi-story building structure. In particular, it relates to a novel bucket-well (also called a bucket-well structure), and an associated preliminary upright stabilizer system, that are designed to aid in such an installation.

When a column which is to be employed in a building frame structure is installed, it is, of course, necessary that the column be placed in a true vertical condition, with its central axis properly located relative to the horizontal. The column must also be suitably stabilized in the correct vertical position until it has become appropriately anchored in place. With regard to a column which rises directly from a building foundation, or from what is known as a podium slab (which typically resides just overhead the first level in a multi-story building), it is extremely important that true verticality and precise lateral locating take place, since any error committed at this stage of building frame structure can telegraph into significant positional errors in higher stories or levels in a building. It is also important that, relative to its long axis, a column be in the correct rotational disposition. Finally, once such column orienting has happened, it is important to capture and lock the disposition of a column's base so as to secure the efforts made to position it correctly.

The present invention specifically addresses these matters by providing what is referred to herein as a bucket-well that is suitably embedded in a building foundation or in a podium slab, with this bucket-well including a well having an upwardly facing receiving opening for receiving the base of a column inside the well. Such an opening has sufficient lateral clearance, relative to the footprint of a column, to allow that column to be adjusted laterally and vertically angularly so as to position it in a precision manner relative to the horizontal and to a plumb line. This bucket-well also freely permits column rotation about its own long axis. Providing these opportunities for adjustment is a significant feature and advantage offered by the present invention. For example, in a typical installation, there is usually only a very tiny amount, say about one-eighth-inches, of forgiveness provided for adjusting the correctness of the lateral position of the base of a column. A preferred embodiment of the present invention, as will be seen, preferably offers significantly more adjustability clearance, for example, allowing adjustment of the base of a column in substantially any lateral direction, back and forth, up to one to two inches. Additionally, this enhanced lateral clearance readily accommodates adjustments in verticality, and axial rotation.

During the preliminary stages of column installation with respect to a foundation or a podium slab, it is, as was earlier mentioned, very important that the column be stabilized in an upright position until it has become securely anchored in place. The present invention offers a unique openable and closeable, tripodically supported collar structure having legs which can rest on a foundation or on a podium slab, and an openable and closeable collar which can be suitably closed on and around the outside of an upright column, relatively near to the base. This structure provides initial stabilizing support against undesired tilting of an about-to-be installed column. When the column has been anchored in place, this collar support structure can be removed for use with the installation of another column.

With the base of a column received within the bucket-well structure of this invention, and according to practice of this invention, a suitable conventional grouting substance, initially in a fluid-flowable form, is poured into the bucket-well to fill the same around the outside of the received base end of a column. This grouting substance, referred to herein as an anchoring material, cures and hardens to capture, contain, and "position-lock" the base of a column. Preferably, the invention is employed with a hollow, tubular type column, and the wall in this column, near the base, is furnished with at least one throughbore, or access opening, that opens to the inside and to the outside of the column in order to enable poured grout within the bucket-well mentioned to flow into the inside of the column, thus to create a through-wall, bridging anchoring portion of the anchoring material, which greatly enhances the anchoring and securing of the base of a column in the bucket-well.

Preferably also, an optional foot plate is anchored across the bottom end of a column, with this plate having a perimeter which is larger than the footprint of the column, thus to create a shoulder/shelf-like-extension which circumsurrounds the outside of the column. With curing of the mentioned grouting substance, and as will be seen shortly, this extension functions to prevent vertical lift of a column relative to its anchored position in the preferred embodiment of the bucket-well of this invention.

These and other features and advantages which are attained by the present invention will become more fully apparent as the description which now follows is read in conjunction with the accompanying drawings.

In none of these three drawing figures is there anything which is necessarily drawn to scale. Rather, structural elements are pictured at appropriate scales in order to enable a clear understanding of the features of the invention.

DETAILED DESCRIPTION OF THE INVENTION

Figure 1:
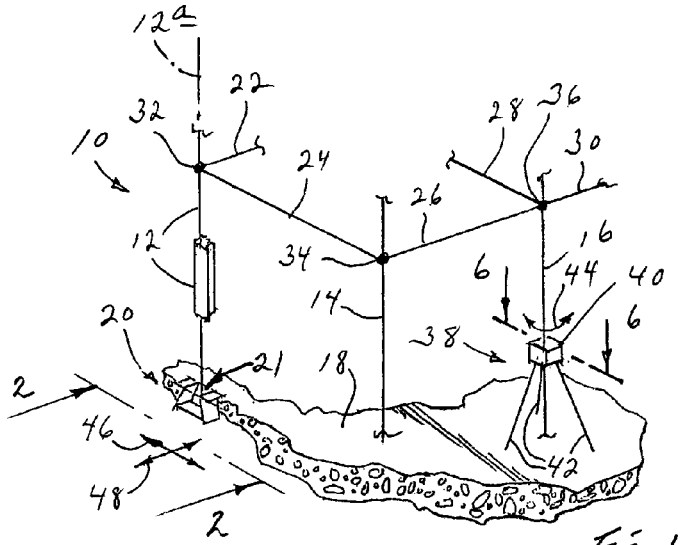
FIG. 1 is a fragmentary, stylized and schematic isometric view illustrating the structure of the present invention in a preferred and best mode form under circumstances where upright columns are being installed relative to a concrete podium slab which will form part of a multi-story building.

Turning now to the drawings, and referring first of all to FIG. 1, indicated generally at 10, in a high level schematic form, is a multi-story building frame structure, including upright columns, three of which are shown at 12, 14, 16, which have their bases anchored to a foundation structure 18, which herein takes the form of what is known as a podium slab. These column bases are so anchored through a bucket-well (also referred to as a bucket-well anchoring and interface system) such as the one shown at 20, constructed in accordance with a preferred and best-mode embodiment and manner of practicing the present invention. Bucket-well 20 includes an upwardly facing well 21. In order to simplify FIG. 1 in the drawings, only the base of column 12, where that base is directly anchored to foundation 20, is specifically shown in this figure. It should be understood, however, that all other columns, such as columns 14, 16, have their bases similarly anchored and contained within foundation 20.

The columns in building frame structure 10 are interconnected through horizontally extending beams, such as the five beams shown at 22, 24, 26, 28, 30, with nodal connections which exist between the beams and columns represented only schematically in FIG. 1 by three large black dots, shown at 32, 34, 36. The exact natures of these nodal connections form no part of the present invention and thus no further details about them are given herein.

Shown generally 38 in FIG. 1, in association with column 16, is a preferred and best-mode form of what is referred herein as an installation-assist brace structure which includes a selectively openable and closeable collar structure 40 which, in FIG. 1, is supported above foundation 20 by three tripodically supporting elongate legs 42. A double ended curved arrow 44 in FIG. 1 is provided to represent the capability of collar 40 for opening and closing around the sides of an upright column, such as around the sides of column 16 as shown in FIG. 1.

With respect to the way in which column 12 is specifically shown in FIG. 1, one will notice that a vertical central portion of this column is shown fragmentarily to be hollow and to have basically a square cross section. While the present invention, as will become apparent, may be used with various different styles of columns, a preferred embodiment of the invention is illustrated and described herein in conjunction with such a column which is tubular and hollow, and generally square in cross-sectional configuration.

Shown at 46, 48 near the lower left side of FIG. 1 are two doubled-ended straight arrows which cross one another, and which are provided to illustrate the capability which is afforded by the bucket-well structure of the present invention, such as the one shown at 20, to allow for a significant and useful amount of lateral, or horizontal, adjustable positioning of the base of a column which is being installed. This allowance assures that the column's positioning, in a horizontal "plan" manner of thinking, may be precisely accomplished. As will become apparent, the bucket-well structure of this invention uniquely accommodates such positioning, and does so especially well in cooperation with an overhead stabilizing collar brace structure, such as that shown at 38 in FIG. 1.

Figure 2:
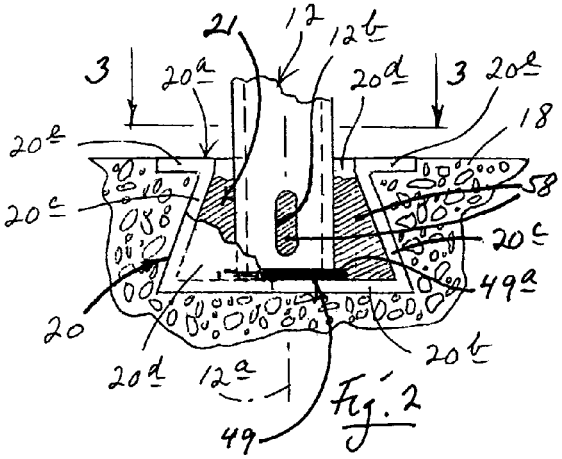
FIG. 2 is an enlarged fragmentary detail taken generally along the line 2—2 in FIG. 1.
Figure 3:
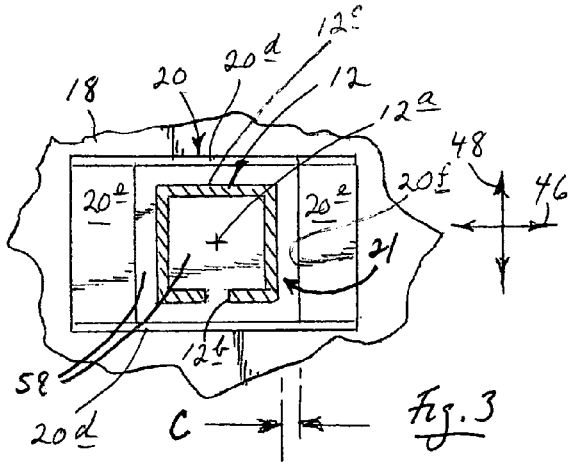
FIG. 3 is a view, on a slightly larger scale than that employed in FIG. 2, taken generally along the line 3—3 in FIG. 2.

Referring now to FIGS. 2 and 3 along with FIG. 1, bucket-well 20 is formed herein from plate steel material, and includes a central component 20*a* which, as viewed from a side, such as in FIG. 2, has a kind of double, back-to-back Z configuration, including a base 20*b*, and a pair of downwardly and outwardly flaring opposed walls 20*c*. Bucket-well 20 also includes a pair of appropriately shaped side plates 20*d* which close off the sides of the bucket-well. The upper edges of walls 20*c* join with outwardly and oppositely extending planar shoulders 20*e* which lie substantially flush with the top surface of foundation 18. The remainder (lower portion) of the bucket-well is appropriately embedded within this foundation which is made of concrete. It will be apparent that, because of the particular shape thus provided for bucket-well 20, and with particular reference made to outwardly and downwardly flaring walls 20*c*, the bucket-well is positively captured and restrained from any inadvertent vertical movement upwardly out of its embedded condition in the foundation.

As was mentioned earlier herein, the various structural components which are illustrated in the figures herein have not been drawn particularly to scale. Given this, it should be understood that the depth of the well, which is thus created as an upwardly facing volume within structure 20, might typically be about 1-foot or so. This depth is, of course, purely a matter of designer choice.

Preferably, the open top of this upwardly facing well space in structure 20 has a defining perimetral rim outline (rim) and configuration 20*f* (see FIG. 3) which, with the particular column for which it is intended extending with its base downwardly into the well, is sized so as to provide a substantial lateral clearance space around the outside of the column, and between the column, and the upwardly facing opening of the well in structure 20. In FIG. 3 in the drawings, column 12 is shown therein in an idealized centered position relative to structure 20, with the column's long axis, which is shown at 12*a*, essentially centered in the receiving space provided by this well. As can be seen in FIG. 3, column 12 has a defined perimetral outline (or cross-section footprint) 12*c* which is smaller than that of well rim 20*f*. Under these circumstances, and again speaking from a preferability point of view, a side clearance space is afforded adjacent the four sides of column 12, which clearance space is shown at C in FIG. 3, of about 1-inch. This clearance space thus offers the opportunity for a significant amount of lateral positioning orthogonally, as is indicated by previously mentioned arrows 46, 48, within the receiving well in structure 20. This clearance space assures that when the column is ready for final positioning in building frame structure 10, it may be accurately positioned to the correct horizontal plan location.

Shown as a thick dark line 49 in FIG. 2 is a horizontal foot plate which is anchored, as by welding, to the bottom end of column 12. The perimeter of this foot plate extends as a horizontal shoulder 49*a* which circumsurrounds the outside of the column. As will become clear shortly, this perimeter-extending foot plate plays a useful role ultimately in preventing vertical lifting of the column within the bucket-well. The open top of the bucket-well is large enough to permit downward passage of this foot plate during insertion of the column base into the well.

Figure 6:
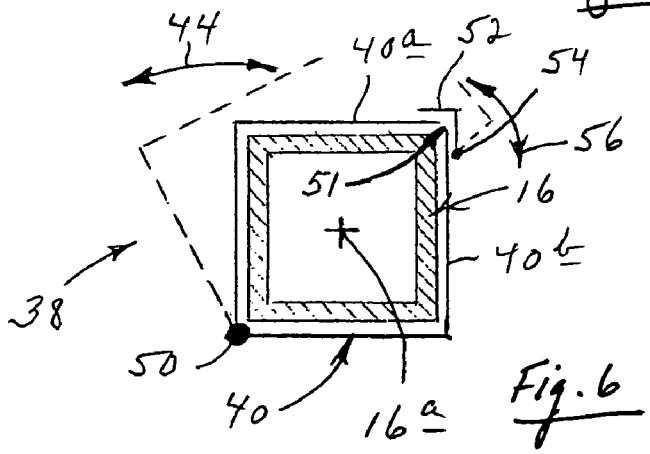
FIG. 6 is an enlarged, fragmentary, cross-sectional detail taken generally along the line 6—6 in FIG. 1 illustrating the operation of a collar stabilizer structure which is also shown in FIG. 1.

Greatly aiding in this practice of positioning a column within the well of a structure like structure 20 is previously mentioned brace structure 38. Referring to FIG. 6 now along with FIGS. 1–3, inclusive, collar 40 in brace 38 includes a pair (herein) of right-angle shaped collar sections 40*a*, 40*b* which are hinged for swinging toward and away from one another, generally as indicated by double-ended curved arrow 44 in FIGS. 1 and 6. Such swinging takes place about a suitable hinge axis which is provided by a hinge mechanism shown generally at 50 in FIG. 6. In solid lines in FIG. 6, collar sections 40*a*, 40*b* are shown closed around the outside of column 16 whose long axis 16*a* is shown centered within the closed collar structure. In dashed lines, collar section 40*a* is shown in FIG. 6 in a somewhat swung-counterclockwise condition, thus partially opening the collar around column 16. Any form of appropriate latch mechanism, such as that illustrated schematically at 51 in FIG. 6, may be employed releasably to latch and release the collar sections for opening, and for holding them closed. For illustration purposes in FIG. 6, latch mechanism 51 is shown with a swingable component 52 which is hinged at 54 for reversible swinging, as is indicated by doubled-ended curved arrow 56 in FIG. 6.

Obviously, it is relevant that the particular shape which is provided for openable and closeable collar sections in a collar structure 40, in accordance with this invention, be configured to produce a snug fit around the outside of whatever column is being installed in a building frame structure.

During installation of a column, the same is initially gripped and lowered in any appropriate conventional fashion to place its base within the receiving well, such as well 21, in a bucket-well structure, such as structure 20. An installation brace structure with a collar like collar 40 a suitably positioned with the collar closed around this column to help stabilize it in a generally upright condition. The support legs and feet of this brace structure are suitably placed on, and even temporarily anchored to, the top surface of the surrounding foundation. Then, the column is adjusted, with the supporting collar helping to stabilize it, so as to position its base within a receiving well, such as well 21, so as to be precisely located in a horizontal plan condition as desired in the building frame structure.

Once a column is properly in place with its base correctly positioned and received within a bucket-well, and with the column stabilized by a brace structure, such as structure 38, a conventional, free-flowing fluid grout substance, such as that shown at 58 in FIGS. 2 and 3, is poured into the bucket-well to fill the same in the space between the column and the inside walls of the bucket-well, thus to complete the anchoring process upon setting and hardening of this poured substance. Substance 58 is also referred to herein as a bulk anchoring material, and the region of this substance which is disposed in the well around the column is referred to as a skirt.

With regard to the employment of such a grouting substance, it is preferred that at least one of the side walls in the base of a column be provided with a suitable opening, or through-wall passage, which opens both to the inside and to the outside of the column. Such an opening provides an opportunity for poured grout to flow into the interior of the base of a column, thus further to assure secure confinement and anchoring of the base of the column. In FIGS. 2 and 3, such an opening is shown generally at 12*b* in column 12. Grout occupying the outside of the base of column 12 is referred to as a volume, and the portion of grout which extends through passage 12*b* is referred to as a continuum portion, and as a bridging anchoring portion.

With curing and hardening of the poured grout material, any tendency of the secured column base to lift upwardly in the bucket-well is resisted both by the "bridging" of grout from the outside to the inside of the column base through opening 12*b*, and also by a wedging action which occurs between the grout skirt and the bucket-well's sloped walls 20*c* as urged by foot plate shoulder 49*a*.

Figure 4:
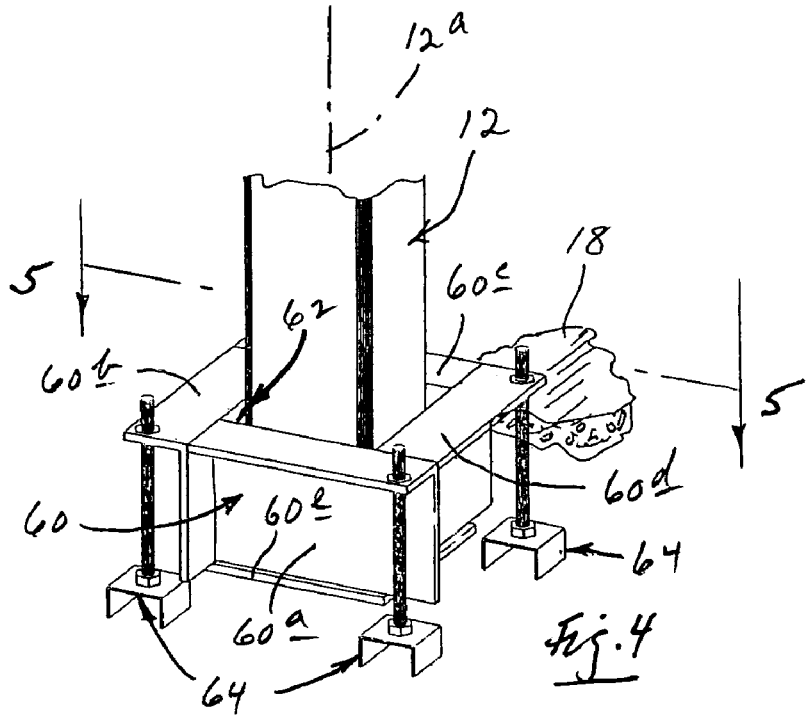
FIG. 4 is a fragmentary isometric view illustrating the base of an upright column received within the well of an alternative form of bucket-well foundation anchoring structure constructed in accordance with a modified form of the invention.
Figure 5:
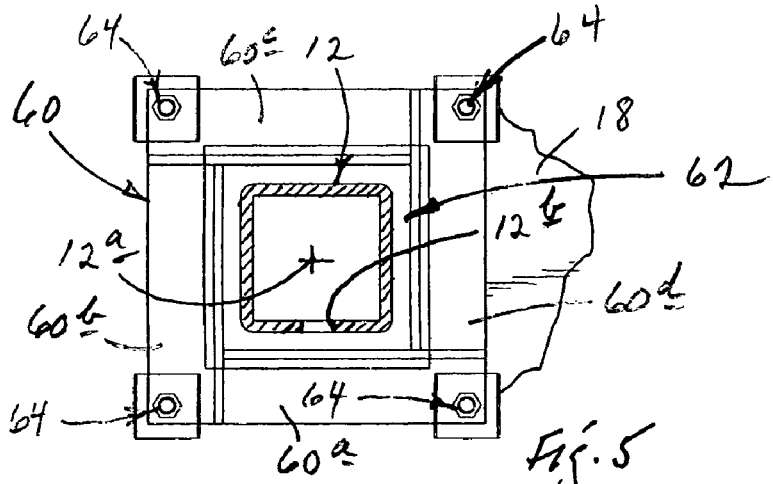
FIG. 5 is a fragmentary view taken generally along the line 5—5 in FIG. 4.

FIGS. 4 and 5 in the drawings show one potential modified form 60 of the bucket-well structure of the present invention. Structure 60 is employed and shown, as in FIGS. 1–3, inclusive, in the context of the base of column 12. This alternative form of bucket-well structure is seen to be made from a welded-together plurality (four) of angular plates 60*a*, 60*b*, 60*c*, 60*d* which are disposed in what can be thought of as a somewhat pinwheel-like arrangement. A base plate 60*e* closes off the base of an open topped well 62 which is provided by structure 60. The well in structure 60 is essentially rectilinear from every point of view, and this bucket-well structure is suitably embedded in foundation 18, and provided with auxiliary rod and foot anchoring structures, such as the (four) shown at 64 in FIGS. 4 and 5.

Focusing for a moment on a feature of the invention mentioned earlier, and seen especially well with reference to FIGS. 2, 3 and 5, the "continuum" bridging of grout which extends through opening, or passage, 12*b* in the base of column 12 provides an important vertical lock against upward movement of the column. As can be seen, the lower extremity of this grout continuum furnishes what may be thought of as vertical abutment engagement, blockage and interference against column lifting by virtue of the fact that it directly overlies the upwardly facing lower perimetral edge of passage 12*b* (see especially FIG. 2). A "facial" view of this lower edge of passage 12*b* is seen exposed (i.e. without grout yet engaging it) in FIG. 5. It is this "lower edge" vertical abutment engagement condition which produces the important lock against vertical, upward column movement of column 12 out of the bucket-well of the invention.

Thus, the invention is described.

It should be understood that, while a preferred embodiment, and one modification thereof, of a bucket-well structure constructed in accordance with the present invention have been shown and described herein, it is entirely possible for other differently shaped bucket-well structures, differently embedded and anchored in a foundation or in a podium slab, may be employed. In each case, it is important that the bucket-well structure be appropriately embedded and anchored against retraction upwardly from a receiving foundation, etc. It is also important that the upwardly facing, initially open top of the bucket-well be sized appropriately to receive the downward insertion of the base of a column, and to provide lateral clearance, such as clearance C shown in FIG. 3, to enable appropriate multi-directionally lateral repositioning of the received column base.

Additionally, and while shown also is a preferred embodiment of what has been referred to herein as an installation-assist brace structure, such a structure may be differently configured to handle different types of columns.

Accordingly, it is appreciated that other variations and modifications of bucket-well and brace structures may be made without departing from the spirit of the invention.

I claim:

1. A building foundation anchoring and interface system for the base of an upright, elongate, hollow, tubular-walled structural column which possesses a defined cross-section footprint with a defined perimetral outline, and a base with at least one through-wall passage which opens to the outside and to the hollow interior of that base, with said passage including and upwardly facing lower edge, said system, in operative condition relative to such a foundation and column, comprising a bucket-well structure embedded in and anchored to such a foundation, and presenting, adjacent the upper surface of that foundation, an open-topped well having an upwardly facing cross-sectional configuration with a defining perimetral rim which is larger, in an all-around perimetral sense, than the perimetral outline of the column's cross-sectional footprint, said well receiving the downwardly extending base of the column with the column extending upwardly from said well, and collectively with said rim, allowing for limited multi-directional adjustable lateral positioning of an upright column whose base is received in the well, a now-solidified, though once fluid-flowable, bulk anchoring material including (a) a skirt portion generally filling the well on the outside of the downwardly extending column base, (b) a volume which exists within the column base interior, and (c) a bridging anchoring portion which extends as a continuum through said through-wall passage, said anchoring material's said skirt portion, volume, and bridging anchoring portion thereby collectively stabilizing such base against movement relative both to said bucket-well structure and to the building foundation, with vertical abutment, vertical locking engagement existing between said bridge anchoring portion and said lower edge in said passage, and installation-assist brace structure including a selectively openable/closeable collar structure adapted (a) to grip, and (b) to release-from, the outside of such a column at a location therealong spaced upwardly from the column base when the latter is received in said well.

2. The system of claim 1 which is further for use in relation to the base of a column which is provided with a shoulder-extending foot plate whose perimeter is larger than that of the column's footprint, and the bucket-well structure includes a pair of opposing, downwardly and outwardly flared walls which cooperate with such a foot plate's shoulder extension, and with the presence of the mentioned bulk anchoring material, to promote a resistive wedging action that inhibits upward movement of the column base within the bucket-well structure.

3. A building foundation anchoring and interface system for the base of an upright, elongate hollow and tubular-walled structural column which possesses a defined cross-section footprint with a defined perimetral outline, and a through-wall passage which opens to the outside, and to the hollow interior, of the column near the column's base, with said passage including an upwardly facing lower edge, said system, in operative condition relative to such a foundation and column, comprising a bucket-well structure embedded in and anchored to such a foundation, and presenting, adjacent the upper surface of that foundation, an open-topped well having an upwardly facing cross-sectional configuration with a defining perimetral rim which is larger, in an all-around perimetral sense, than the perimetral outline of the column's cross-sectional footprint, said well receiving the downwardly extending base of the column with the column extending upwardly from said well, and collectively with said rim, allowing for limited multi-directional adjustable lateral positioning of an upright column whose base is received in the well, and stabilizing such base against movement relative both to said bucket-well structure and to the building foundation, a now-solidified, through once fluid-flowable, bulk anchoring material including (a) a skirt portion generally filling the well on the outside of the downwardly extending column base, (b) a volume which exists within the column base interior, and (c) a continuum portion which extends homogeneously through said passage and joins with said volume and said skirt portion.

* * * * *